United States Patent [19]

Masumoto et al.

[11] Patent Number: 4,950,452

[45] Date of Patent: Aug. 21, 1990

[54] HIGH STRENGTH, HEAT RESISTANT ALUMINUM-BASED ALLOYS

[75] Inventors: Tsuyoshi Masumoto; Akihisa Inoue, both of Sendai; Katsumasa Odera, Kurobe, all of Japan

[73] Assignees: Yoshida Kogyo K. K.; Tsuyoshi Masumoto, both of Tokyo, Japan; part interest to each

[21] Appl. No.: 324,049

[22] Filed: Mar. 16, 1989

[30] Foreign Application Priority Data

Mar. 17, 1988 [JP] Japan ..... 63-61878

[51] Int. Cl.[5] ..... C22C 21/00

[52] U.S. Cl. ..... 420/550; 75/249; 420/552; 148/437; 148/438

[58] Field of Search ..... 75/249; 420/550, 552; 148/437, 438

[56] References Cited

U.S. PATENT DOCUMENTS 3,964,935 6/1976 Wilks ..... 148/437
4,213,799 7/1980 Raghavan et al. ..... 148/11.5 A
4,787,943 11/1988 Mahajan et al. ..... 148/437
4,851,193 7/1989 Mahajan et al. ..... 420/550

*Primary Examiner*—Stephen J. Lechert, Jr.

[57] ABSTRACT

The present invention provides high strength, heat resistant aluminum-based alloys having a composition represented by the general formula $Al_aM_bCe_c$, wherein M is at least one metal element selected from the group consisting of V, Cr, Mn, Fe, Co, Ni, Cu and Nb; and a, b and c are atomic percentages falling within the following ranges:

$$50 \leqq a \leqq 93,\ 0.5 \leqq b \leqq 35 \text{ and } 0.5 \leqq c \leqq 25,$$

the aluminum alloy containing at least 50% by volume of amorphous phase. The aluminum-based alloys are especially useful as high strength, high heat resistant materials in various applications and since they exhibit superplasticity in the vicinity of their crystallization temperature, they can be easily processed into various bulk materials by extrusion, press woring or hot-forging at the temperatures within the range of the crystallization temperature ±100° C.

2 Claims, 1 Drawing Sheet

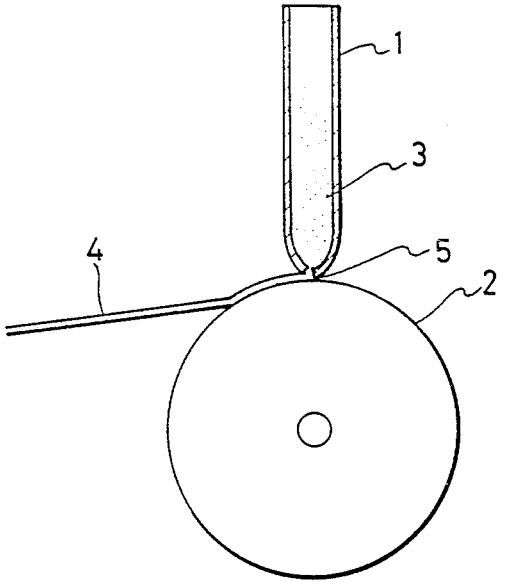
1
3
4
5
2

HIGH STRENGTH, HEAT RESISTANT ALUMINUM-BASED ALLOYS

BACKGROUND OF THE INVENTION

1. Field of the Invention

The present invention relates to aluminum-based alloys having a desired combination of properties of high hardness, high strength, high wear-resistance and high heat-resistance.

2. Description of the Prior Art

As conventional aluminum-based alloys, there have been known various types of aluminum-based alloys, such as Al-Cu, Al-Si, Al-Mg, Al-Cu-Si, Al-Cu-Mg, Al-Zn-Mg alloys, etc. These aluminum-based alloys have been extensively used in a wide variety of applications, such as structural materials for aircrafts, cars, ships or the like; outer building materials, sash, roof, etc; structural materials for marine apparatuses and nuclear reactors, etc., according to their properties.

The conventional aluminum-based alloys generally have a low hardness and a low heat resistance. Recently, attempts have been made to impart a finestructure to aluminum-based alloys by rapidly solidifying the alloys and thereby improve the mechanical properties, such as strength, and chemical properties, such as corrosion resistance. However, the rapidly solidified aluminum-based alloys known up to now are still unsatisfactory in strength, heat resistance, etc.

SUMMARY OF THE INVENTION

In view of the foregoing, it is an object of the present invention to provide novel aluminum-based alloys having an advantageous combination of high strength and superior heat-resistance at relatively low cost.

Another object of the present invention is to provide aluminum-based alloys which have high hardness and high wear-resistance properties and which can be subjected to extrusion, press working, a large degree of bending, etc.

According to the present invention, there are provided aluminum-based alloys having high strength and heat resistance, the aluminum-based alloys having a composition represented by the general formula:

$$Al_aM_bCe_c$$

wherein:

M is at least one metal element selected from the group consisting of V, Cr, Mn, Fe, Co, Ni, Cu and Nb; and a, b and c are atomic percentages falling within the following ranges:

$$50 \leqq a \leqq 93,\ 0.5 \leqq b \leqq 35 \text{ and } 0.5 \leqq c \leqq 25,$$

the aluminum-based alloys containing at least 50% by volume of amorphous phase. In the general formula, Ce element may be replaced by a misch metal (Mm) and the same effects can be obtained.

The aluminum-based alloys of the present invention are useful as high hardness materials, high strength materials, high electric-resistance materials, good wear-resistant materials and brazing materials. Further, since the aluminum-based alloys exhibit superplasticity in the vicinity of their crystallization temperature, they can be successfully processed by extrusion, press working or the like. The processed articles are useful as high strength, high heat resistant materials in many practical application because of their high hardness and high tensile strength properties.

BRIEF DESCRIPTION OF THE DRAWING

The single figure is a schematic illustration of a single roller-melting apparatus employed to prepare thin ribbons from the alloys of the present invention by a rapid solidification process.

DETAILED DESCRIPTION OF THE PREFERRED EMBODIMENTS

The aluminum-based alloys of the present invention can be obtained by rapidly solidifying melt of the alloy having the composition as specified above by means of liquid quenching techniques. The liquid quenching technique involve rapidly cooling molten alloy and, particularly, single-roller melt-spinning technique, twin roller melt-spinning technique and inrotating-water melt-spinning technique are mentioned as especially effective examples of such techniques. In these techniques, the cooling rate of about $10^4$ to $10^6$ K/sec can be obtained. In order to produce thin ribbon materials by the single-roller melt-spinning technique or twin roller melt-spinning technique, molten alloy is ejected from the opening of a nozzle to a roll of, for example, copper or steel, with a diameter of about 30–300 mm, which is rotating at a constant rate of about 300–10000 rpm. In these techniques, various thin ribbon materials with a width of about 1–300 mm and a thickness of about 5–500 μm can be readily obtained. Alternatively, in order to produce wire materials by the in-rotating-water melt-spinning technique, a jet of the molten alloy is directed, under application of the back pressure of argon gas, through a nozzle into a liquid refrigerant layer with a depth of about 1 to 10 cm which is formed by centrifugal force in a drum rotating at a rate of about 50 to 500 rpm. In such a manner, fine wire materials can be readily obtained. In this technique, the angle between the molten alloy ejecting from the nozzle and the liquid refrigerant surface is preferably in the range of about 60° to 90° and the ratio of the relative velocity of the ejecting molten alloy to the relative velocity of the liquid refrigerant surface is preferably in the range of about 0.7 to 0.9.

Besides the above techniques, the alloy of the present invention can be also obtained in the form of thin film by a sputtering process. Further, rapidly solidified powder of the alloy composition of the present invention can be obtained by various atomizing processes, for example, high pressure gas atomizing process or spray process.

Whether the rapidly solidified aluminum-based alloys thus obtained are amorphous or not can be known by checking the presence of halo patterns characteristic of an amorphous structure using an ordinary X-ray diffraction method. The amorphous structure is converted into a crystalline structure by heating to a certain temperature (called "crystallization temperature") or higher temperatures.

In the aluminum alloys of the present invention represented by the above general formula, a, b and c are limited to the ranges of 50 to 93 atomic %, 0.5 to 35 atomic % and 0.5 to 25 atomic %, respectively. The reason for such limitations is that when a, b and c stray from the respective ranges, it is difficult to produce an amorphous structure in the resulting alloys and the intended alloys having at least 50 volume % of amorphous phase can not be obtained by industrial rapid cooling techniques using the above-mentioned liquid quenching, etc.

The element M which is at least one metal element selected from the group consisting of V, Cr, Mn, Fe, Co, Ni, Cu and Nb has an effect in improving the ability to produce an amorphous structure and greatly improves the corrosion-resistance. Further, the element M not only provides improvements in hardness and strength, but also increases the crystallization temperature, thereby enhancing the heat resistance.

Further, since the aluminum-based alloys of the present invention exhibit superplasticity in the vicinity of their crystallization temperatures (crystallization temperature ±100° C.), they can be readily subjected to extrusion, press working, hotforging, etc. Therefore, the aluminum-based alloys of the present invention obtained in the form of thin ribbon, wire, sheet or powder can be successfully processed into bulk materials by way of extrusion, pressing, hot forging, etc., at the temperature within the range of their crystallization temperature ±100 ° C. Further, since the aluminum-based alloys of the present invention have a high degree of toughness, some of them can be bent by 180° without fracture.

Now, the advantageous features of the aluminum-based alloys of the present invention will be described with reference to the following examples.

Examples

Molten alloy 3 having a predetermined composition was prepared using a high-frequency melting furnace and was charged into a quartz tube 1 having a small opening 5 with a diameter of 0.5 mm at the tip thereof, as shown in the figure. After heating and melting the alloy 3, the quartz tube 1 was disposed right above a copper roll 2. Then, the molten alloy 3 contained in the quartz tube 1 was ejected from the small opening 5 of the quartz tube 1 under the application of an argon gas pressure of 0.7 kg/cm$^2$ and brought into contact with the surface of the roll 2 rapidly rotating at a rate of 5,000 rpm. The molten alloy 3 was rapidly solidified and an alloy thin ribbon 4 was obtained.

According to the processing conditions as described above, there were obtained 22 kinds of aluminum-based alloy thin ribbons (width: 1 mm, thickness: 20 μm) having the compositions (by at. %) as shown in the Table. The thin ribbons thus obtained were subjected to X-ray diffraction analysis and, as a result, halo patterns characteristic of amorphous structure were confirmed in all of the thin ribbons.

Crystallization temperature Tx (K) and hardness Hv (DPN) were measured for each test specimen of the thin ribbons and the results are shown in a right column of the Table. The hardness (Hv) is indicated by values (DPN) measured using a micro Vickers hardness tester under load of 25 g. The crystallization temperature (Tx) is the starting temperature (K) of the first exothermic peak on the differential scanning calorimetric curve which was obtained at a heating rate of 40 K/min. In the Table, "Amo" represents "amorphous". "Bri" and "Duc" represent "brittle" and "ductile" respectively and

TABLE

| No. | Composition | Structure | Tx(K) | Hv(DPN) | Property |
|---|---|---|---|---|---|
| 1. | $Al_{88}V_2Ce_{10}$ | Amo | 511 | 157 | Bri |
| 2. | $Al_{85}Cr_5Ce_{10}$ | Amo | 505 | 301 | Bri |
| 3. | $Al_{87}Cr_3Ce_{10}$ | Amo | 514 | 262 | Bri |

TABLE-continued

| No. | Composition | Structure | Tx(K) | Hv(DPN) | Property |
|---|---|---|---|---|---|
| 4. | $Al_{85}Mn_5Ce_{10}$ | Amo | 607 | 359 | Bri |
| 5. | $Al_{80}Fe_{10}Ce_{10}$ | Amo | 628 | 1038 | Bri |
| 6. | $Al_{85}Fe_5Ce_{10}$ | Amo | 605 | 315 | Duc |
| 7. | $Al_{88}Fe_{10}Ce_2$ | Amo | 565 | 716 | Duc |
| 8. | $Al_{80}Co_{10}Ce_{10}$ | Amo | 626 | 434 | Bri |
| 9. | $Al_{88}Co_{10}Ce_2$ | Amo | 527 | 281 | Duc |
| 10. | $Al_{85}Co_5Ce_{10}$ | Amo | 607 | 305 | Duc |
| 11. | $Al_{80}Ni_{10}Ce_{10}$ | Amo | 625 | 408 | Duc |
| 12. | $Al_{70}Ni_{20}Ce_{10}$ | Amo | 718 | 558 | Bri |
| 13. | $Al_{60}Ni_{30}Ce_{10}$ | Amo | 734 | 652 | Bri |
| 14. | $Al_{88}Ni_{10}Ce_2$ | Amo | 409 | 330 | Duc |
| 15. | $Al_{85}Ni_5Ce_{10}$ | Amo | 580 | 265 | Duc |
| 16. | $Al_{80}Cu_{10}Ce_{10}$ | Amo | 499 | 334 | Bri |
| 17. | $Al_{85}Cu_5Ce_{10}$ | Amo | 512 | 281 | Duc |
| 18. | $Al_{80}Nb_{10}Ce_{10}$ | Amo | 498 | 203 | Duc |
| 19. | $Al_{85}Nb_5Ce_{10}$ | Amo | 504 | 157 | Duc |
| 20. | $Al_{80}Nb_5Ni_5Ce_{10}$ | Amo | 608 | 338 | Bri |
| 21. | $Al_{80}Fe_5Ni_5Ce_{10}$ | Amo | 667 | 945 | Bri |
| 22. | $Al_{80}Cr_3Cu_7Ce_{10}$ | Amo | 562 | 328 | Bri |

As shown in the Table, the aluminum-based alloys of the present invention have an extremely high hardness of the order of about 200 to 1000 DPN, in comparison with the hardness Hv of the order of 50 to 100 DPN of ordinary aluminum-based alloys. It is particularly noted that the aluminum-based alloys of the present invention have very high crystallization temperatures Tx of at least about 440 K and exhibit a high heat resistance.

The alloy No. 7 given in the Table was examined for the strength using an Instron-type tensile testing machine. The tensile strength was about 102 kg/mm$^2$ and the yield strength was about 95 kg/mm$^2$. These values are 2.2 times of the maximum tensile strength (about 45 kg/mm$^2$) and maximum yield strength (about 40 kg/mm$^2$) of conventional age-hardened Al-Si-Fe aluminum-based alloys.

What is claimed is:

1. A high strength, heat resistant aluminum-based alloy having a composition represented by the general formula:

$$Al_aM_bCe_c$$

wherein:

M is at least one metal element selected from the group consisting of V, Cr, Mn, Fe, Co, Ni, Cu and Nb; and a, b and c are atomic percentages falling within the following ranges:

$$50 \leqq a \leqq 93,\ 0.5 \leqq b \leqq 35 \text{ and } 0.5 \leqq c \leqq 25,$$

said aluminum-based alloy containing at least 50% by volume of an amorphous phase.

2. A high strength, heat resistant aluminum-based alloy having a composition represented by the general formula:

$$Al_aM_bMm_c$$

wherein:

M is at least one metal element selected from the group consisting of V, Cr, Mn, Fe, Co, Ni, Cu and Nb;

Mm is a misch metal; and a, b and c are atomic percentages falling within the following ranges:

$$50 \leqq a \leqq 93,\ 0.5 \leqq b \leqq 35 \text{ and } 0.5 \leqq c \leqq 25,$$

said aluminum-based alloy containing at least 50% by volume of an amorphous phase.

* * * * *